US012628941B1

(12) United States Patent
Chrisco

(10) Patent No.: US 12,628,941 B1
(45) Date of Patent: May 19, 2026

(54) ADJUSTABLE TABLE

(71) Applicant: Michael A. Chrisco, Overland Park, KS (US)

(72) Inventor: Michael A. Chrisco, Overland Park, KS (US)

( * ) Notice: Subject to any disclaimer, the term of this patent is extended or adjusted under 35 U.S.C. 154(b) by 109 days.

(21) Appl. No.: 18/601,225

(22) Filed: Mar. 11, 2024

Related U.S. Application Data

(60) Provisional application No. 63/489,342, filed on Mar. 9, 2023.

(51) Int. Cl.
*A47B 9/04* (2006.01)
*A47B 13/08* (2006.01)
*A47B 37/04* (2006.01)

(52) U.S. Cl.
CPC ..... *A47B 9/04* (2013.01); *A47B 13/081* (2013.01); *A47B 37/04* (2013.01); *A47B 2200/004* (2013.01)

(58) Field of Classification Search
CPC .. A47B 9/00; A47B 9/04; A47B 11/00; A47B 13/02; A47B 13/023; A47B 13/081; A47B 13/088; A47B 37/04; A47B 2200/004
See application file for complete search history.

(56) References Cited

U.S. PATENT DOCUMENTS 2,388,056 A * 10/1945 Hendricks ..... F16B 7/1409 248/407
2,395,735 A * 2/1946 Grigsby ..... A47B 9/00 187/250
3,092,048 A * 6/1963 Timmermann ..... A47B 9/04 108/138
6,550,728 B1 * 4/2003 Fuhrman ..... F16B 7/1427 108/146
6,886,788 B1 * 5/2005 Chung ..... A47J 37/0786 248/176.2
2011/0232541 A1 * 9/2011 Barracchia ..... A47B 9/00 108/147.19
2011/0303124 A1 * 12/2011 Tseng ..... A47B 37/04 108/23
2013/0081609 A1 * 4/2013 Dhuper ..... A47J 37/0781 126/25 AA
2015/0245704 A1 * 9/2015 Hwang ..... A47B 11/00 108/91
2016/0166109 A1 * 6/2016 Banal ..... A47B 11/00 108/50.13

* cited by examiner

*Primary Examiner* — Daniel J Rohrhoff
(74) *Attorney, Agent, or Firm* — AVEK IP, LLC

(57) ABSTRACT

An adjustable table includes a tabletop, a first helical member, and a second helical member. The adjustable table also includes a support frame coupled to the tabletop and either the first helical member or the second helical member. The adjustable table has a variable height, wherein rotation of the second helical member in one direction relative to the first helical member raises a height of the tabletop and rotation of the second helical member in an opposite direction relative to the first helical member lowers the height of the tabletop.

20 Claims, 16 Drawing Sheets

ADJUSTABLE TABLE

CROSS-REFERENCE TO RELATED APPLICATIONS

This application claims the benefit of priority of U.S. Provisional Patent Application No. 63/489,342, filed Mar. 9, 2023, the entire disclosure of which is incorporated herein by reference.

FIELD OF THE DISCLOSURE

The disclosure relates generally to the field of furniture. More specifically, the disclosure relates to a height-adjustable table having modular elements.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

According to an embodiment, an adjustable table includes a tabletop, a first helical member, and a second helical member. The adjustable table also includes a support frame coupled to the tabletop and either the first helical member or the second helical member. The adjustable table has a variable height, wherein rotation of the second helical member in one direction relative to the first helical member raises a height of the tabletop and rotation of the second helical member in an opposite direction relative to the first helical member lowers the height of the tabletop.

According to another embodiment, an adjustable table includes a first helical rod, a second helical rod stacked atop and being rotatable relative to the first helical rod, and a third helical rod stacked atop and being rotatable relative to the second helical rod. The adjustable table also includes a tabletop operably coupled to the third helical rod. The table is height-adjustable, such that rotation of the second helical rod in a first direction relative to the first helical rod raises a height of the tabletop, and rotation of the third helical rod in the first direction also raises the height of the tabletop. Rotation of the second helical rod in a second direction relative to the first helical rod lowers the height of the tabletop, the second direction being opposite the first direction, and rotation of the third helical rod in the second direction also lowers the height of the tabletop.

BRIEF DESCRIPTION OF THE DRAWINGS

Illustrative embodiments of the present disclosure are described in detail below with reference to the attached drawing figures.

DETAILED DESCRIPTION

Figure 1:
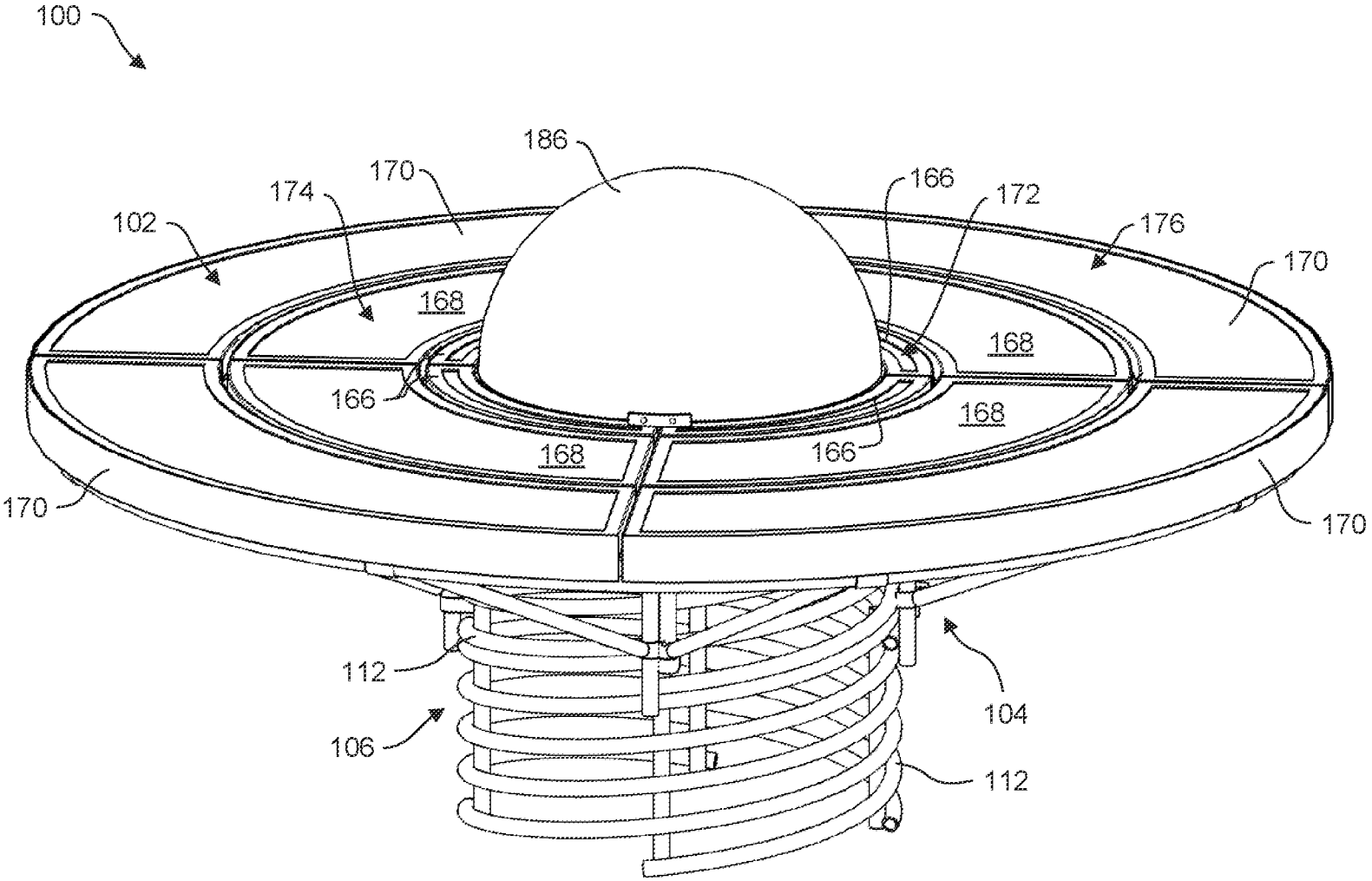
FIG. 1 is a front perspective view of an embodiment of a adjustable table having a modular central element in a first configuration.
Figure 2:
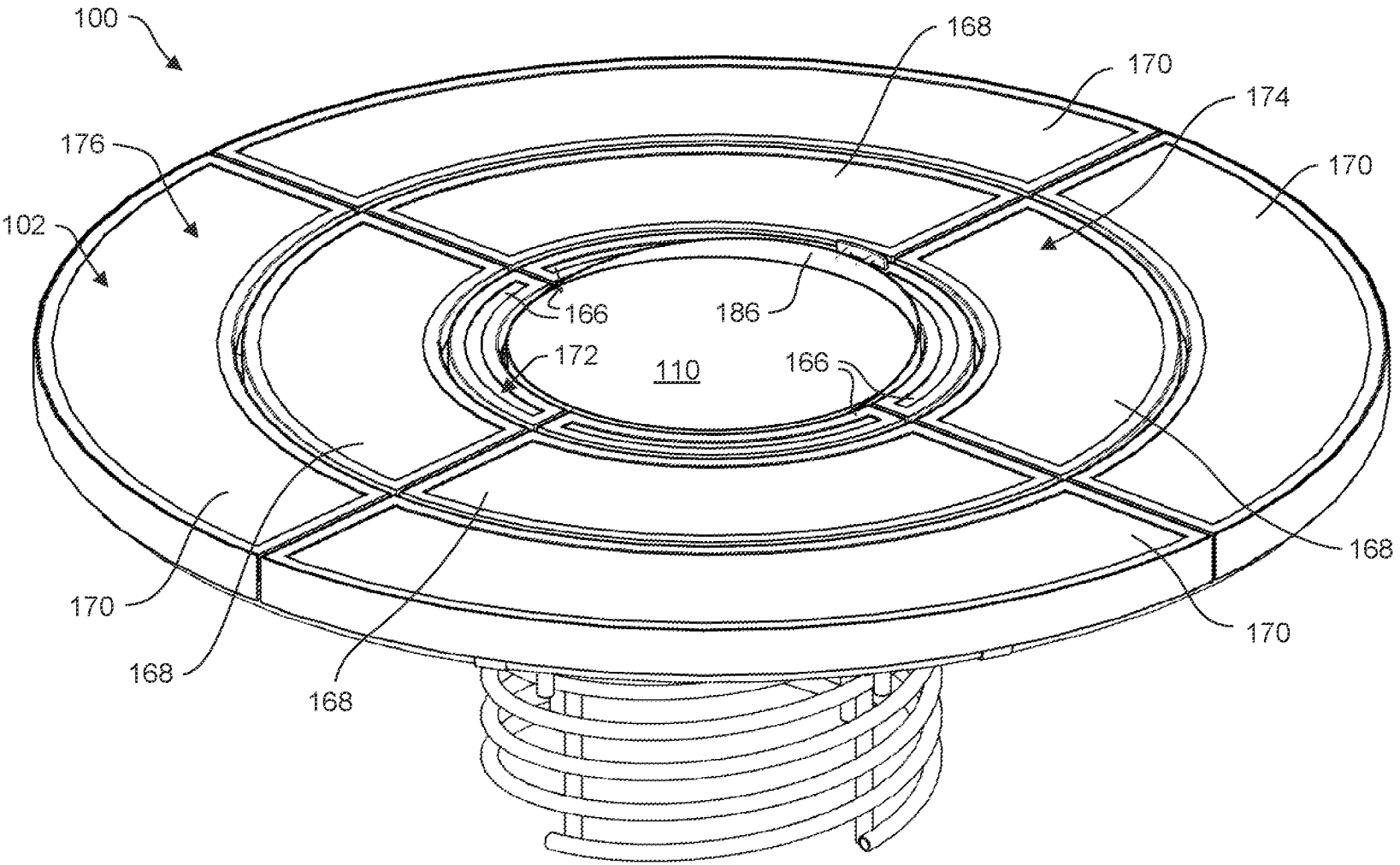
FIG. 2 is a front perspective view of the adjustable table of FIG. 1 having a modular central element in a second configuration.

FIGS. 1-16 depict various aspects of an embodiment of an adjustable table 100. The table 100 generally includes a tabletop 102, a support frame 104 connected to the tabletop 102, and a height adjustment mechanism 106. In the illustrated embodiment, the height-adjustment mechanism 106 is a helical structure formed from one or more helical members 108. The table 100 may be raised or lowered by rotating one or more helical members 108 in a given direction (e.g., clockwise or counter-clockwise) about a substantially vertical axis, relative to another helical members 108. The general helical nature of the height adjustment mechanism 106 allows it to increase or decrease the table height by helical members 108 to slide over each other when rotated. The rotation may be performed manually or, in some embodiments, may be performed at least partially through mechanical actuation such as by a motor. The helical members 108 always support the tabletop 102 and the frame 104 at any height.

Figure 3:
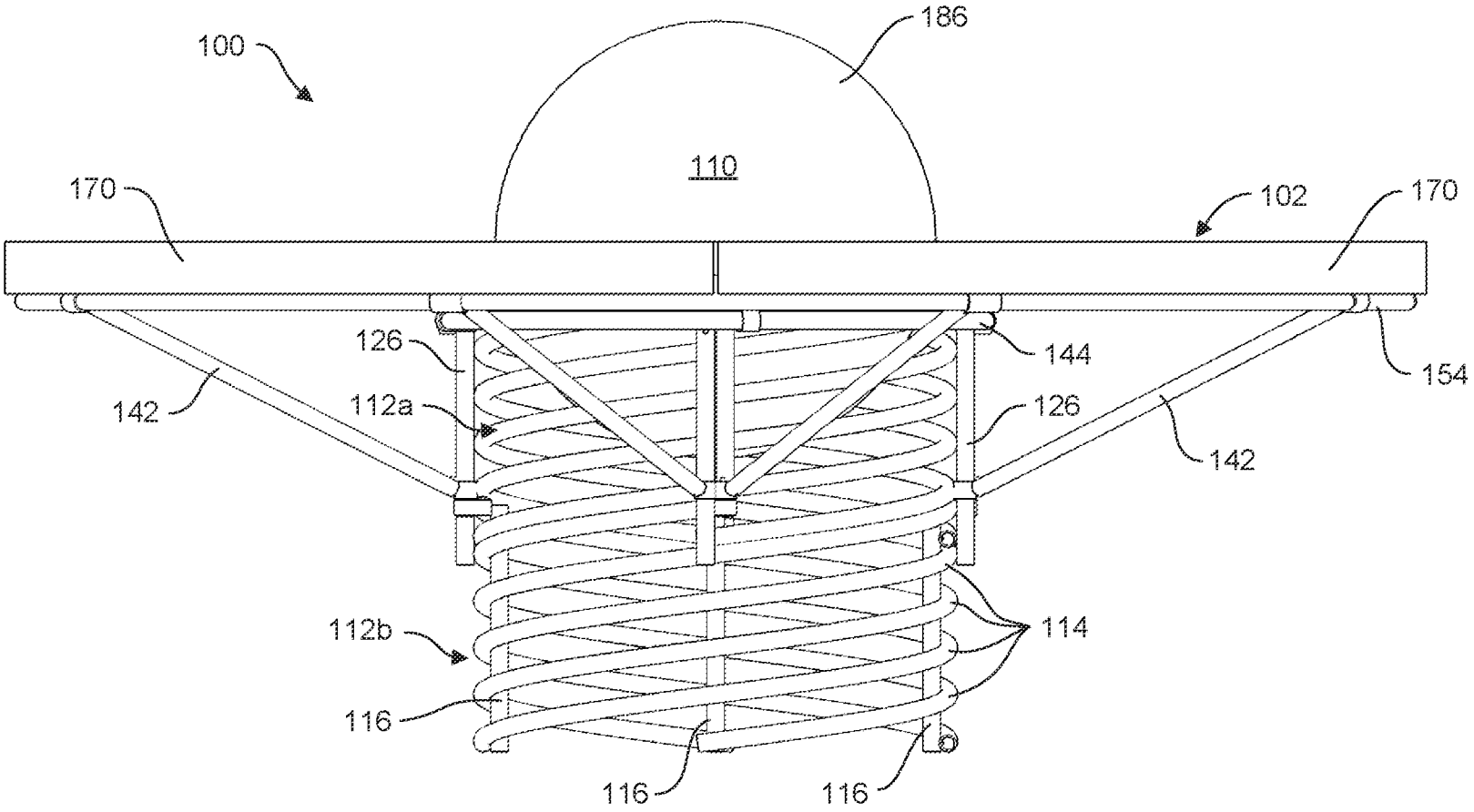
FIG. 3 is a side view of the adjustable table of FIG. 1 at a first height with the modular central element in the first configuration.
Figure 4:
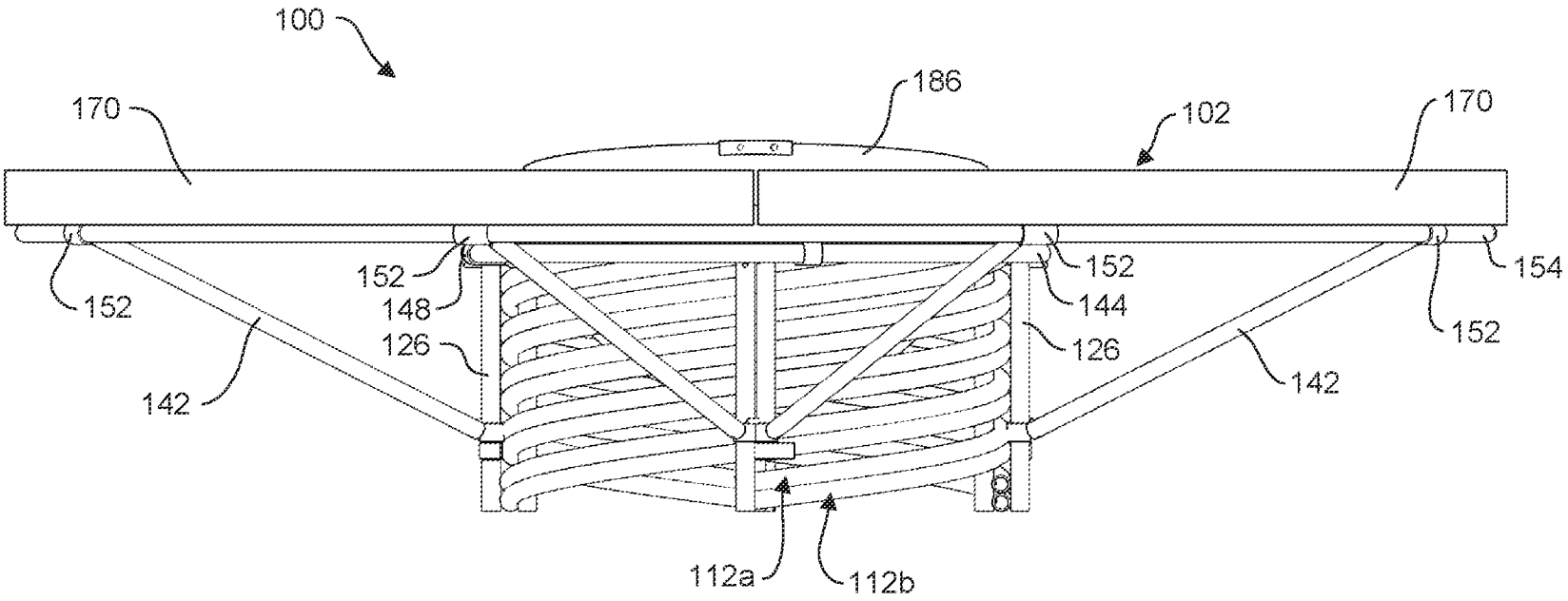
FIG. 4 is a side view of the table of FIG. 1 at a second height with the modular central element in the second configuration.

The table 100 may be adjustable to a variety of common heights, including but not limited to common table height (approximately 28 to 32 inches, as shown in FIG. 3), countertop (approximately 36 inches), bar (approximately 40 to 42 inches), fire pit, or even chair heights (approximately 18 to 20 inches, as shown in FIG. 4). In the illustrated embodiment, the table "height" is considered to be the distance from the top surface of the tabletop 102 to the ground. The height of the table may be adjustable continuously (i.e., not limited to discrete increments) between heights of approximately 18 to 42 inches, although one skilled in the art will appreciate that in other embodiments the table may be outside these dimensions without limiting the scope of the invention. The table 100 generally includes a modular central element 110, which may take the form of one or more recreational or utility items, such as a grill and/or a fire pit.

Figure 5:
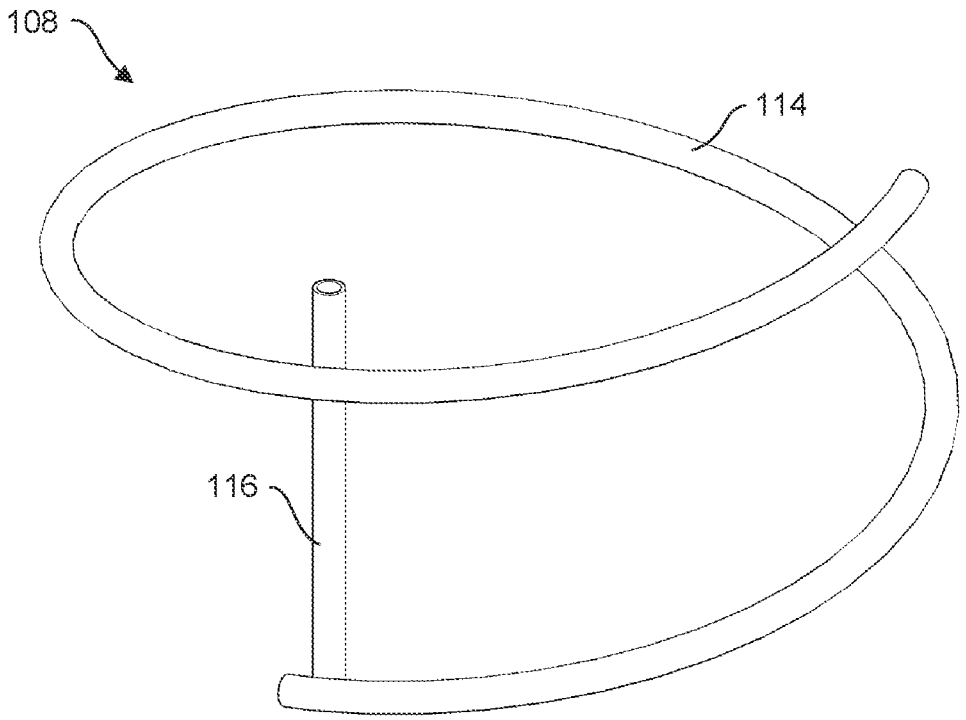
FIG. 5 is a perspective view of a helical support member of the adjustable table of FIG. 1.

The height adjustment mechanism 106, shown as part of table 100 in FIGS. 1-4 and separately from the table 100 in FIGS. 5-9, is a generally helical structure. The height adjustment mechanism 106 may be formed from a single helical coil or helical member 108 or, as in the illustrated embodiment, from a plurality of helical members 108 in a spaced arrangement forming a layer 112. As shown in FIG. 5, each helical member 108 may be formed from a single, continuous helical rod 114. Each helical rod 114 may be formed from metal, such as aluminum used in the illustrated embodiment, although the rods 114 may be formed from any number of materials, including various other metals, alloys, or composites. In the illustrated embodiment, each rod 114 has a generally circular cross-section and has a diameter of approximately one inch, although one of skill in the art will appreciate that the specific diameter of the rod 114 may be any suitable size. Likewise, the rod 114 may have a cross-section shape different to that shown, such as an annular, triangular, rectangular, or I-beam type cross-section, without departing from the scope of the invention.

To increase rigidity, each helical member 108 may also include a vertical support 116 connected to the rod 114 via a rigid connection (such as welding as shown in the illustrated embodiment, or a mechanical fastener). In some embodiments, the vertical support 116 is tangent to an inner diameter of the rod 114, such that the vertical support 116 does not interfere with the height adjustment mechanism 106 when it is in operation. In other embodiments, the vertical support 116 is tangent to an outer diameter of the rod 114. The helical rod 114 preferably extends at least 360 degrees, such that the vertical support 116 may be connected to the rod 114 at multiple locations, and specifically at multiple locations along different horizontal planes. Preferably, each helical rod 114 extends greater than 360 degrees, such that when the helical members 108 are arranged in a layer 112, there is a vertical overlap between adjacent helical members 108. In the illustrated embodiment, the helical rod 114 extends approximately 450 degrees, although in other embodiments the helical rod may exceed 450 degrees without departing from the scope of the invention.

Figure 6:
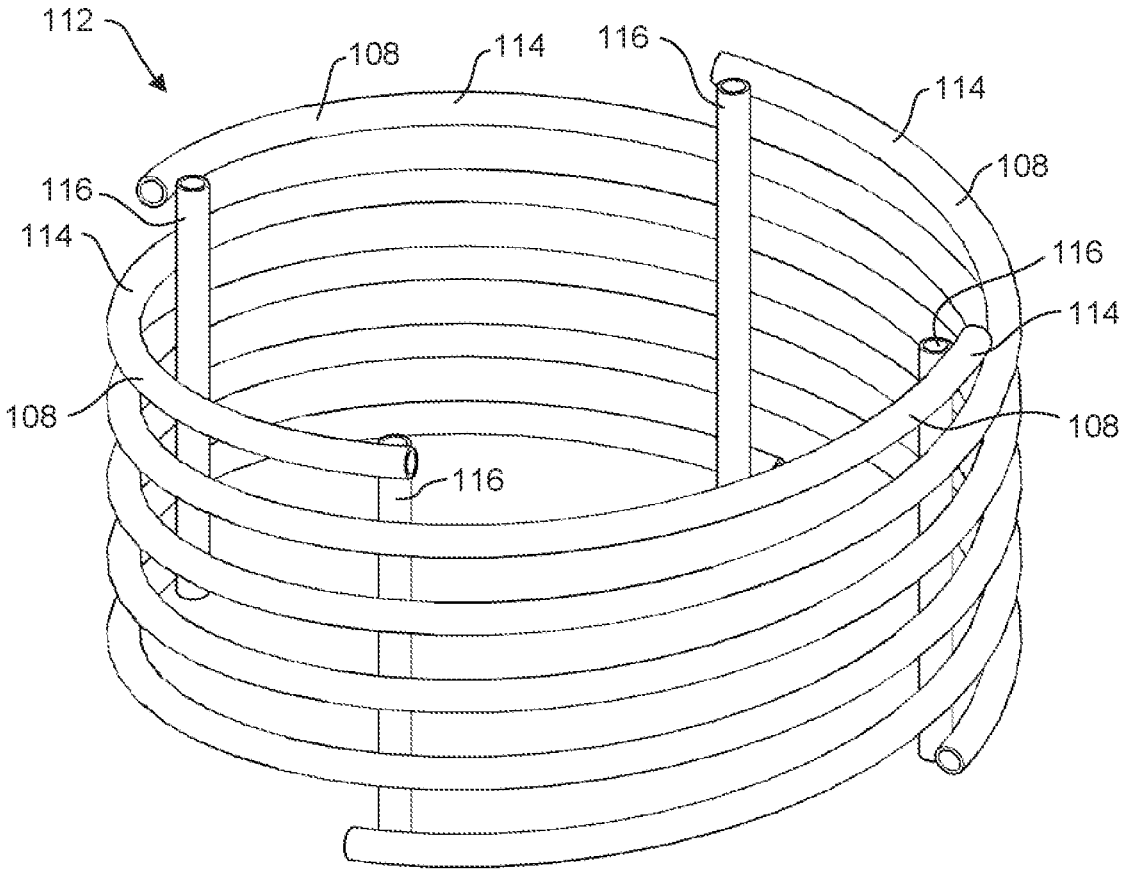
FIG. 6 is a perspective view of a helical support structure of the adjustable table of FIG. 1.

As best seen in FIG. 6, each layer 112 of the height adjustment mechanism 106 may be formed from multiple helical members 108. In the embodiment shown, each layer 112 is formed from four helical members 108, each being evenly radially distributed around a shared circumference (i.e., approximately 90 degrees offset between each helical member 108). In variations with more or less than four helical members 108 per layer 112, these helical members 108 may be spaced equally around the planform circumference of the layer 112 (for example, if there are three helical members 108, they are 120 degrees apart, if there are five helical members 108 they are 72 degrees apart, etc.). Each layer 112 and helical member 108 may be formed such that the relationship between length of each rod 114 (in degrees) and the number of helical members 108 per layer is as follows:

$$\theta = 360\left(1 + \frac{1}{n}\right),$$

wherein θ is the length of each rod 114 in degrees, and n is the number of helical members 108 per layer 112. In other embodiments, the relationship between length of each helical rod 114 and the number of helical members 108 per layer 112 may differ from this formula without departing from the scope of the invention.

Figure 7:
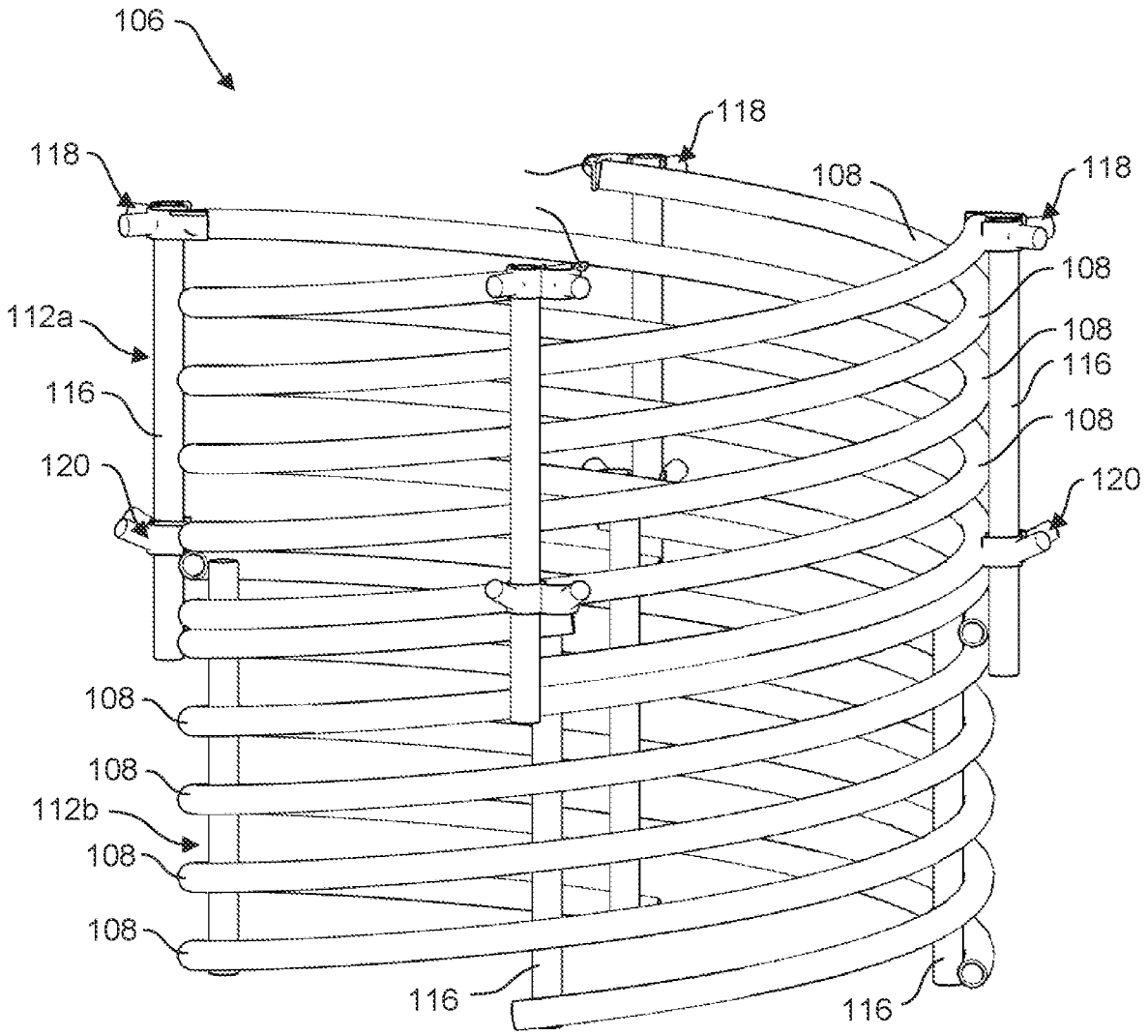
FIG. 7 is a perspective view of a pair of helical support structures of the adjustable table of FIG. 1 in a first stacked configuration.
Figure 8:
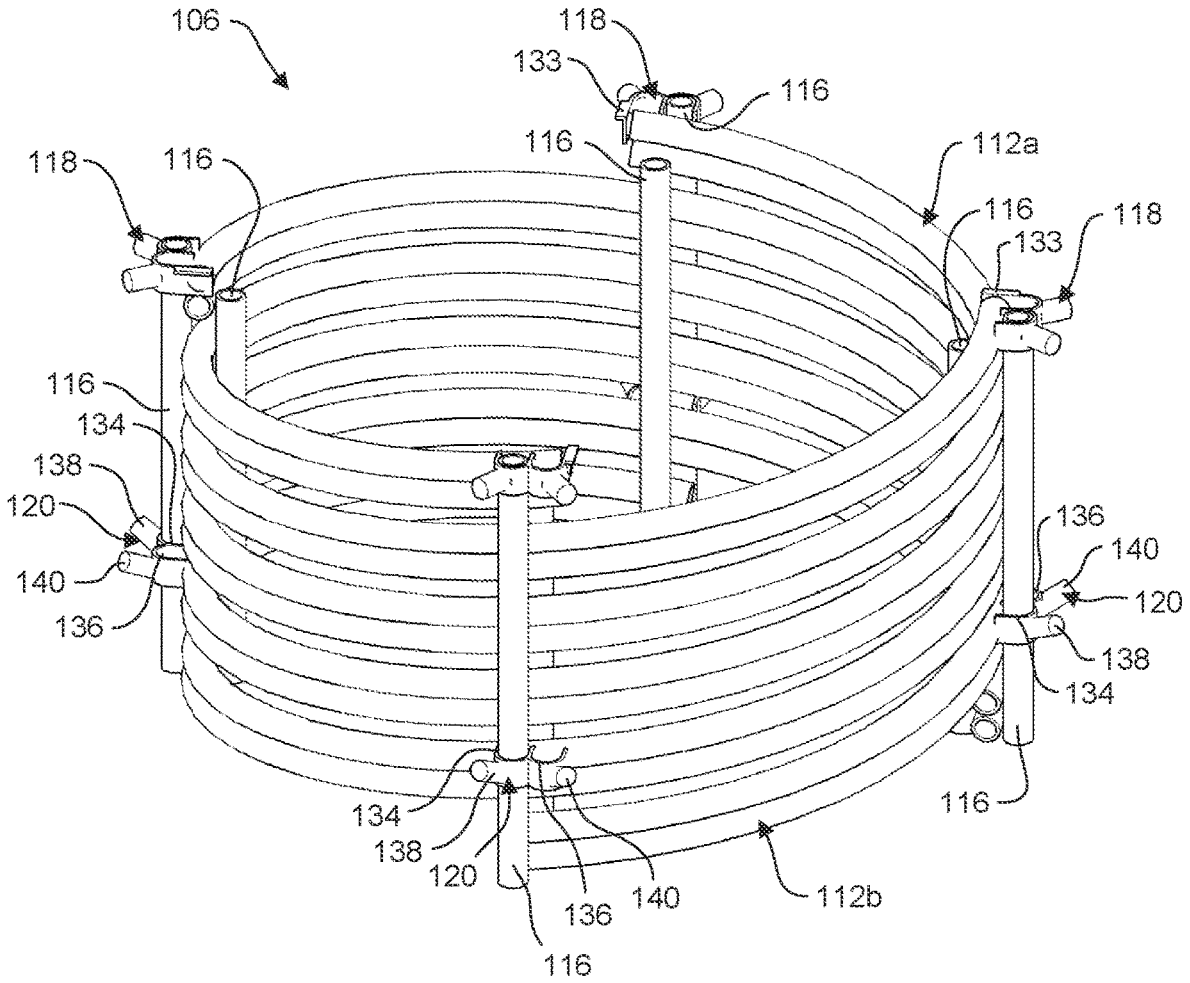
FIG. 8 is a perspective view of a pair of helical support structures of the adjustable table of FIG. 1 in a second stacked configuration.

Referring now to FIGS. 7 and 8, the height adjustment mechanism 106 my be formed from multiple layers 112, such as upper layer 112*a* and lower layer 112*b*, which are arranged in a stacked configuration. Upper layer 112*a* and lower layer 112*b* are substantially similar in function and construction, with lower layer 112*b* being substantially identical to layer 112 shown in FIG. 7. Compared to lower layer 112*b*, the vertical support 116 of each helical member 108 of the upper layer 112*a* is tangent to an outer diameter of the rod 114, whereas the vertical support 116 of each helical member 108 of the lower layer 112*b* is tangent to an inner diameter of the rod 114. This relationship allows the upper layer 112*a* to slide over the lower layer 112*b* (to raise or lower the height of table 100) without substantial interference. FIG. 7 depicts the height adjustment mechanism 106 in a raised state, whereas FIG. 8 depicts the height adjustment mechanism 106 in a collapsed or storage state.

Attached to the upper layer 112*a* of the height adjustment mechanism 106 are upper and lower mounting brackets 118 and 120, respectively, for connecting elements of the support frame 104. Upper mounting bracket 118 includes a first receptacle or slot 122 which is sized to hold a vertical support 116 of the upper layer 112*a* therein. The vertical support 116 may be releasably secured to the upper mounting bracket 118 by a set screw or other mechanical fastener now known or later developed. The upper mounting bracket 118 includes a second receptacle or slot 124 which is configured to releasably secure part of the support frame 104, such as a vertical frame member 126. The first and second slots 122 and 124 may be configured such that a vertical support 116 and a vertical frame member 126 are held in a substantially parallel arrangement. The upper bracket 118 also includes pair of angularly-offset outward-facing projections 128 and 130, which are each configured to hold a horizontal frame member 132. In the illustrated embodiment, the projections 128 and 130 are generally circular in cross section, and the horizontal frame members 132 (seen in FIG. 11) have a generally annular cross-section, whereby the horizontal members 132 slide over the projections 128 and 130 and are secured. The upper bracket 118 also includes a tab or stop 133 which is configured to abut an end of a helical member 108 forming part of the upper layer 112*a*. The tab or stop 133 may help a user align elements of the table 100 and specifically the height adjustment mechanism 106 during construction. In some embodiments, the tab 133 may include a projection configured to slidably mate with an end of a helical member 108 to facilitate alignment of the height adjustment mechanism 106.

The mounting brackets 118 and 120 are similar in shape and function, with a few differences. Similar to upper brackets 118, the lower brackets 120 include a first receptacle or slot 134 and a second receptacle or slot 136, where the first slot 134 is configured to secure a vertical support 116 of the upper helical layer 112*a* and the second slot 136 is configured to hold a vertical frame member 126. The first and second slots 134 and 136 may be configured such that a vertical support 116 and a vertical frame member 126 are held in a substantially parallel arrangement. The lower bracket 120 also includes pair of angularly-offset outward-facing projections 138 and 140. Unlike projections 128 and 130 which extend substantially horizontally, projections 138 and 140 are angled upwards and are configured to hold an angled frame member 142. In the illustrated embodiment, projections 138 and 140 are angled upwards at an angle of approximately 27 degrees, although one of skill in the art will appreciate in other embodiments not shown the projection 138 and 140 may be oriented at another angle without departing from the scope of the invention. Similar to upper bracket projections 128 and 130, the projections 138 and 140 are generally circular in cross section, and the angled frame members 142 (seen in FIG. 11) have a generally annular cross-section, whereby the angled members 142 slide over the projections 138 and 140 and are secured.

Figure 9:
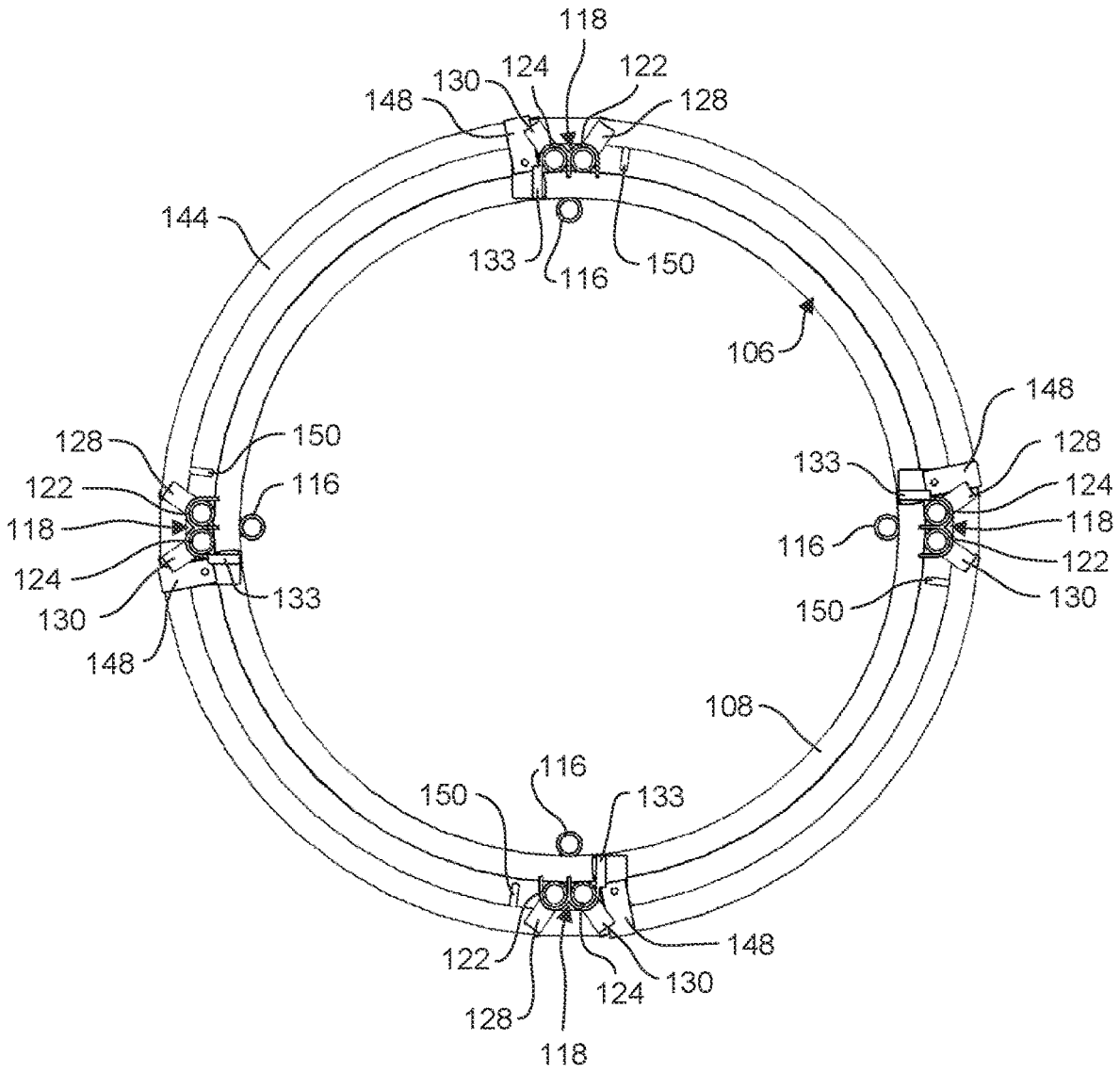
FIG. 9 is a top view of a partial support frame of the adjustable table of FIG. 1.
Figure 10:
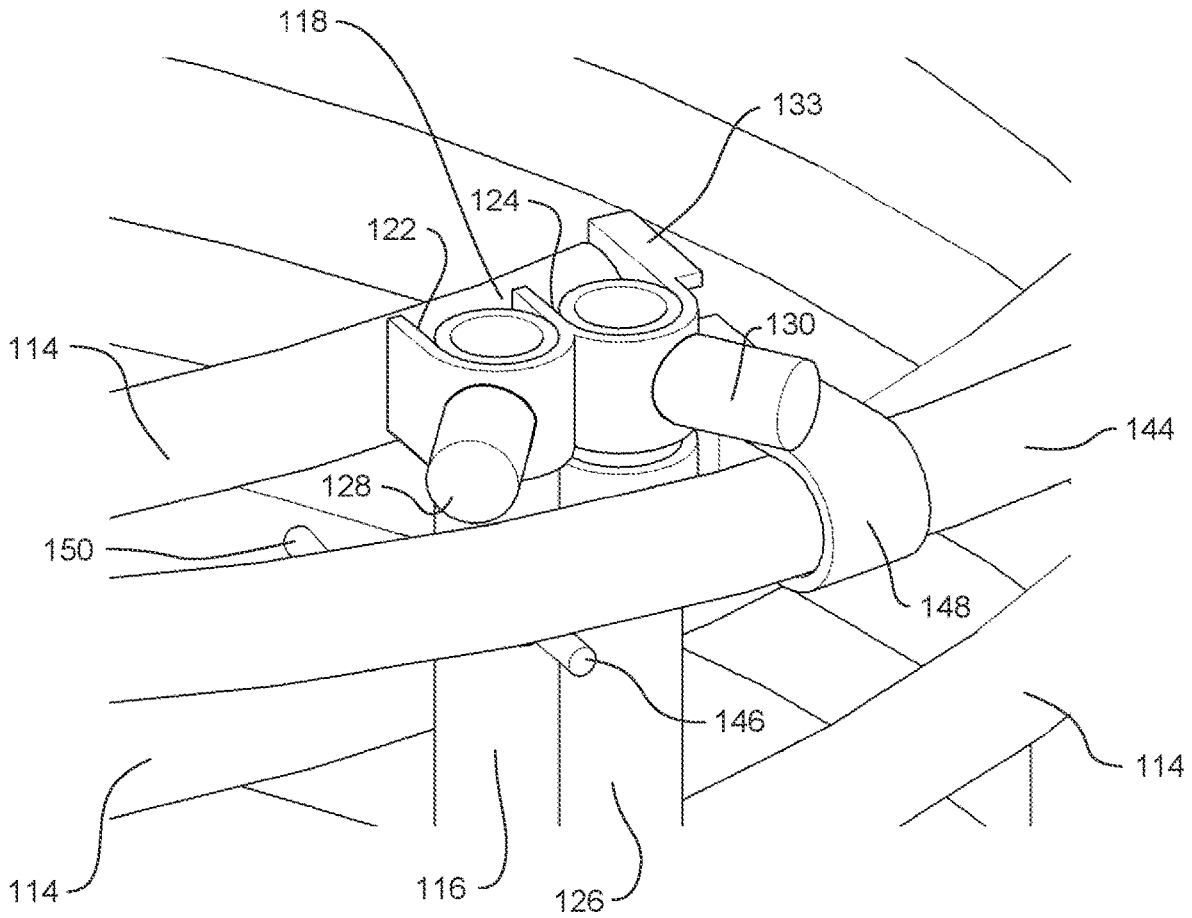
FIG. 10 is a close-up perspective view of an upper support bracket of a partial support frame of the adjustable table of FIG. 1.
Figure 11:
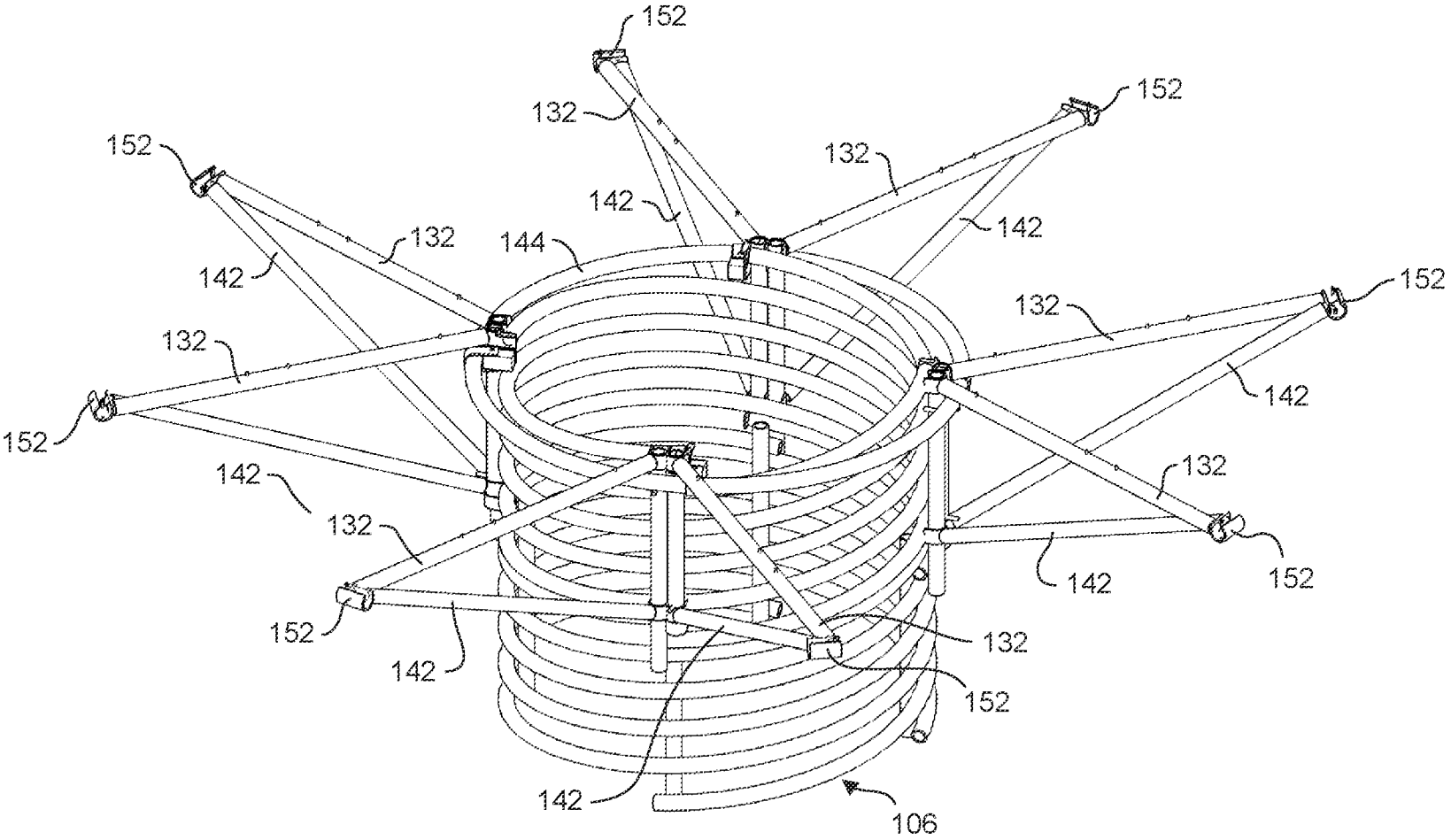
FIG. 11 is a perspective view of a partial support frame of the adjustable table of FIG. 1.

As best shown in FIGS. 9-11, the support frame 104 also includes a central or inner support ring 144. The inner support ring 144 generally has a diameter greater than the diameter of the helical members 108 (as seen in FIG. 9), and is supported by a shelf or projection 146 which extends outwardly from a vertical frame member 132 or from a vertical support 116 as seen in FIG. 10. The inner support ring 144 may also be connected to the height adjustment mechanism 106, and specifically the upper mounting bracket 118, by a U-shaped mount 148. The inner support ring 144 extends through the U-shaped mount 148 which is secured to the upper bracket 118 at one end. The inner support ring 144 may also include a tab or stop 150 which extends inwardly, the stop 150 being configured to limit movement of the tabletop 102 and the frame 104 relative to the height adjustment mechanism 106.

Figure 12:
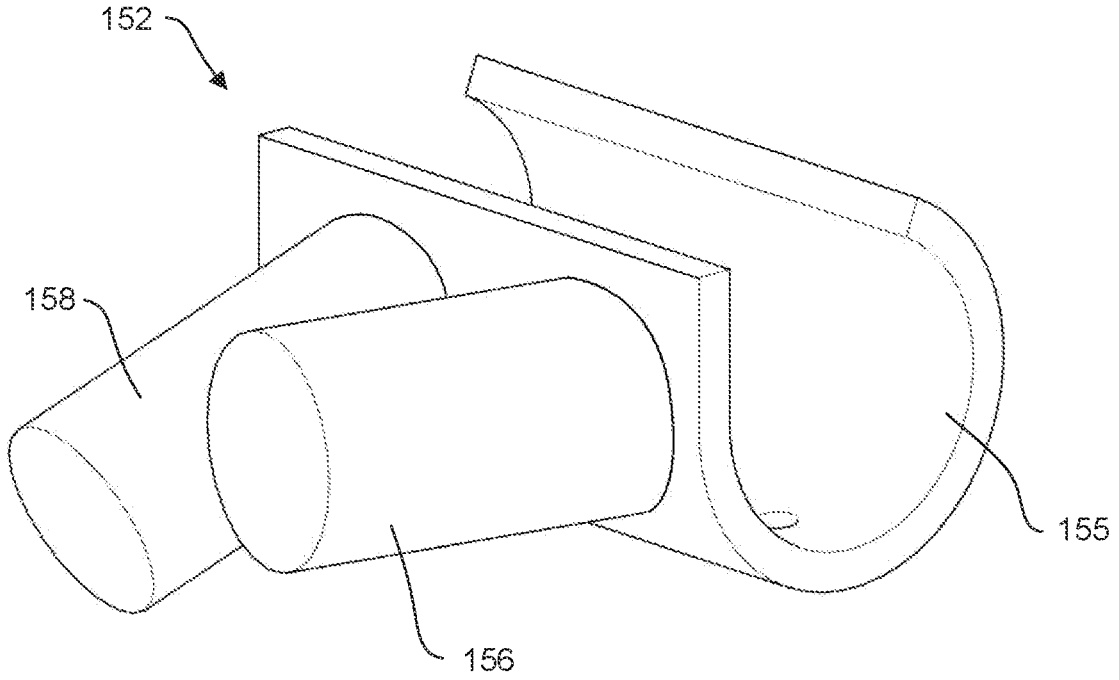
FIG. 12 is a perspective view of a support bracket forming part of the support frame of FIG. 11.
Figure 13:
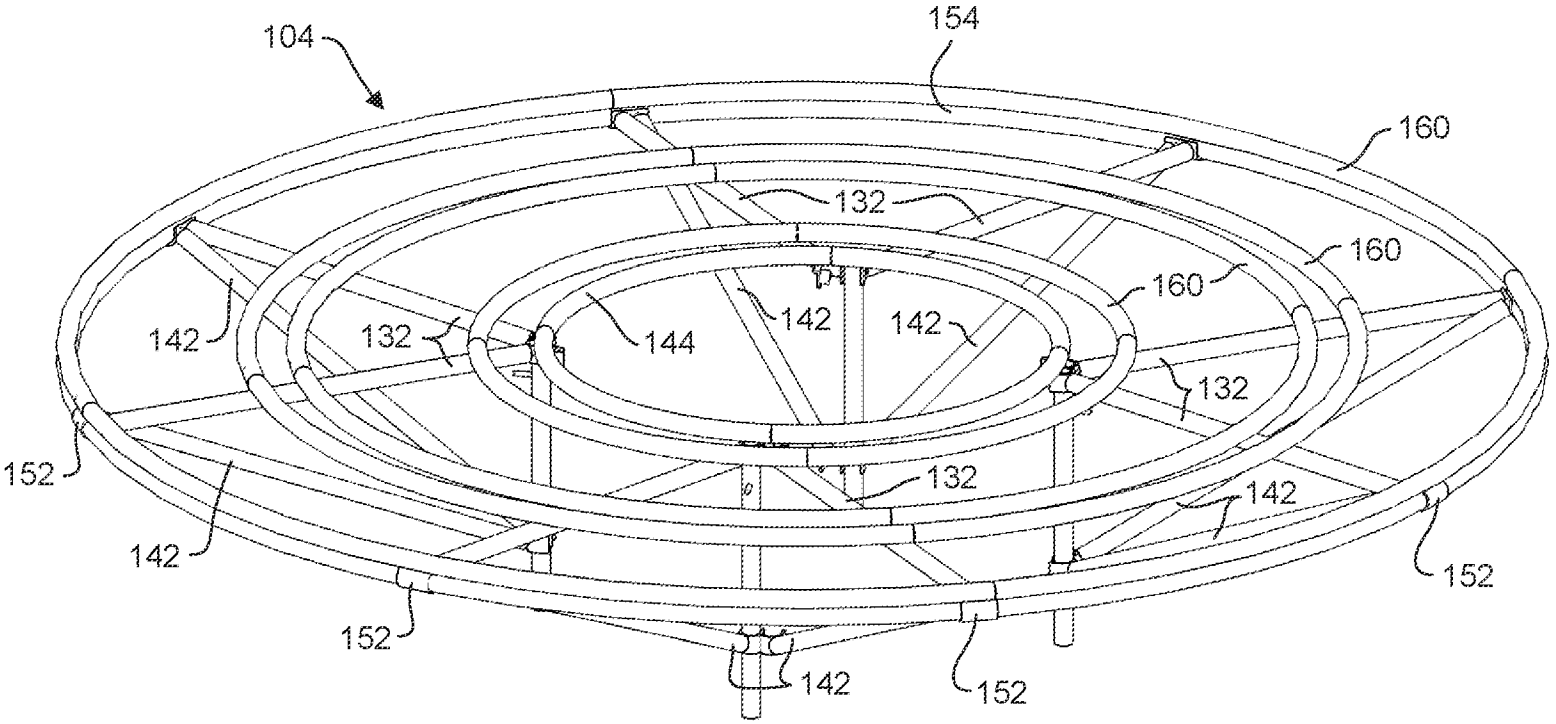
FIG. 13 is a perspective view of a support frame for a tabletop of the adjustable table of FIG. 1.

With reference to FIGS. 11-13, the frame 104 further includes an outer bracket 152 which connects to a horizontal frame member 132 and an angled frame member 142 and is configured to hold an outer support ring 154 in a sleeve 155. The outer bracket 152 includes a pair of projections 156 and 158 which are similar in shape and function to the projections 128, 130, 138, and 140 on the upper and lower brackets respectively. Preferably, the horizontal frame members 132 slidably mate with projection 156, and the angled frame members 142 slidably mate with projection 158. In some embodiments, the outer bracket may be secured to the outer support ring 154 using a set screw. The outer support ring 154 extends generally around a maximum circumference of the table 100 and forms a portion of the outermost structure of the frame 104. Between the inner support ring 144 and the outer support ring 154 may be a plurality of additional support rings 160. The additional support rings 160 generally have a diameter greater than the diameter of the inner support ring 144 and less than a diameter of the outer support ring 154, and each additional ring 160 may be sized to support a designated portion of the tabletop 102. The additional support rings 160 may be secured to the rest of the frame 104 by one or more tabs or dowels located on the horizontal frame members 132. In some embodiments, the additional support rings 160 may be secured to the rest of the frame 104 by one or more set screws inserted at least partially through the horizontal frame members 132.

Figure 14:
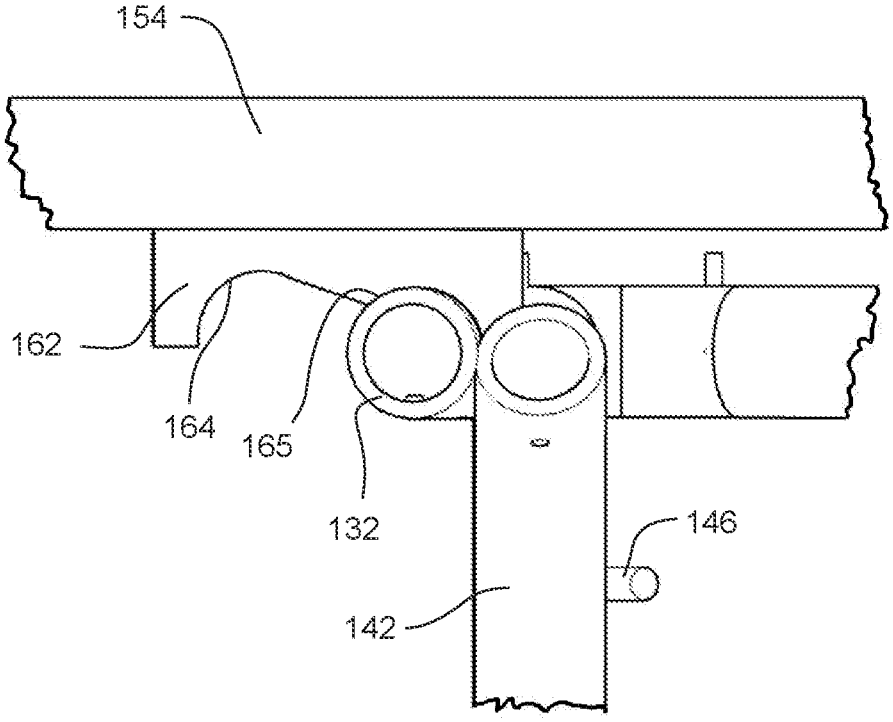
FIG. 14 is a broken perspective view of a tabletop stop of the adjustable table of FIG. 1.

Referring now to FIG. 14, a portion of the support frame 104 including an outer support ring 154 is shown. In some embodiments, the outer support ring 154 may include a stop or brake 162 extending downwardly, the stop 162 being configured to limit movement of the outer ring 154 (and therefore the tabletop 102 when table 100 is fully assembled). The stop 162 includes a first slot 164 and a second slot 165, each slot being configured to hold a horizontal frame member 132. In the embodiment shown, the first slot 164 and the second slot 165 are arranged such that placing a horizontal frame member 132 therein results in a different height of the outer support ring 154. The different heights may allow for the stop 162 to function as a locking mechanism for limiting rotation of the tabletop 102, whereby rotation of outer support ring 154 with stop 162 causes the outer support ring 154 to raise and therefore cause friction with the tabletop which restricts movement. In some embodiments, the stop or brake 162 may be included on another support ring, such as one of the additional support rings 160, instead of on the outer support ring 154 as shown.

As shown in FIGS. 1, 2, 15, and 16, the tabletop 102 may include a plurality of arcuate segments. In the embodiment shown, the tabletop 102 is divided into 12 segments, there being three general sizes of segments: inner segments 166, middle segments 168, and outer segments 170. Each grouping of segments 166-170 may also be referred to as a tabletop ring. For example, inner segments 166 form inner tabletop ring 172, middle segments 168 form middle tabletop ring 174, and outer segments 170 form outer tabletop ring 176. One of skill in the art will appreciate that the specific subdivision of the tabletop 102 shown in the drawings and described herein is not intended to be limiting, and in other embodiments the tabletop may include any number of segments less than or greater than 12, without departing from the scope of the invention.

Dividing the tabletop 102 into segments may provide numerous advantages compared to a solid tabletop; notably reduced shipping volume (and therefore cost) as well as allowing for segments to be removed (such as for cleaning) or replaced (in the event of damage by a user or other external factor) without needing to remove the entire tabletop 102, which may be too cumbersome for one person to do safely or practically. The tabletop 102 may be fashioned from any number of materials, such as metals, alloys, composites, or other suitable materials now known or later developed. In some embodiments not shown, it may be desirable for the different tabletop rings 172-176 to be formed from different materials. For example, in embodiments wherein the modular central element is a grill or a fire pit, the inner tabletop ring 172 may be formed from a more heat- or wear-resistant material than the other tabletop rings. In another embodiment, it may be desirable for one of the tabletop rings to be fashioned from or coated with a gripping material, such as silicone, to reduce the risk of items on the tabletop 102 being knocked over. In yet another embodiment, it may be desirable to replace one segment and/or an entire tabletop ring with identical segments having specific features, such as a cup holder or other utility.

Figure 15:
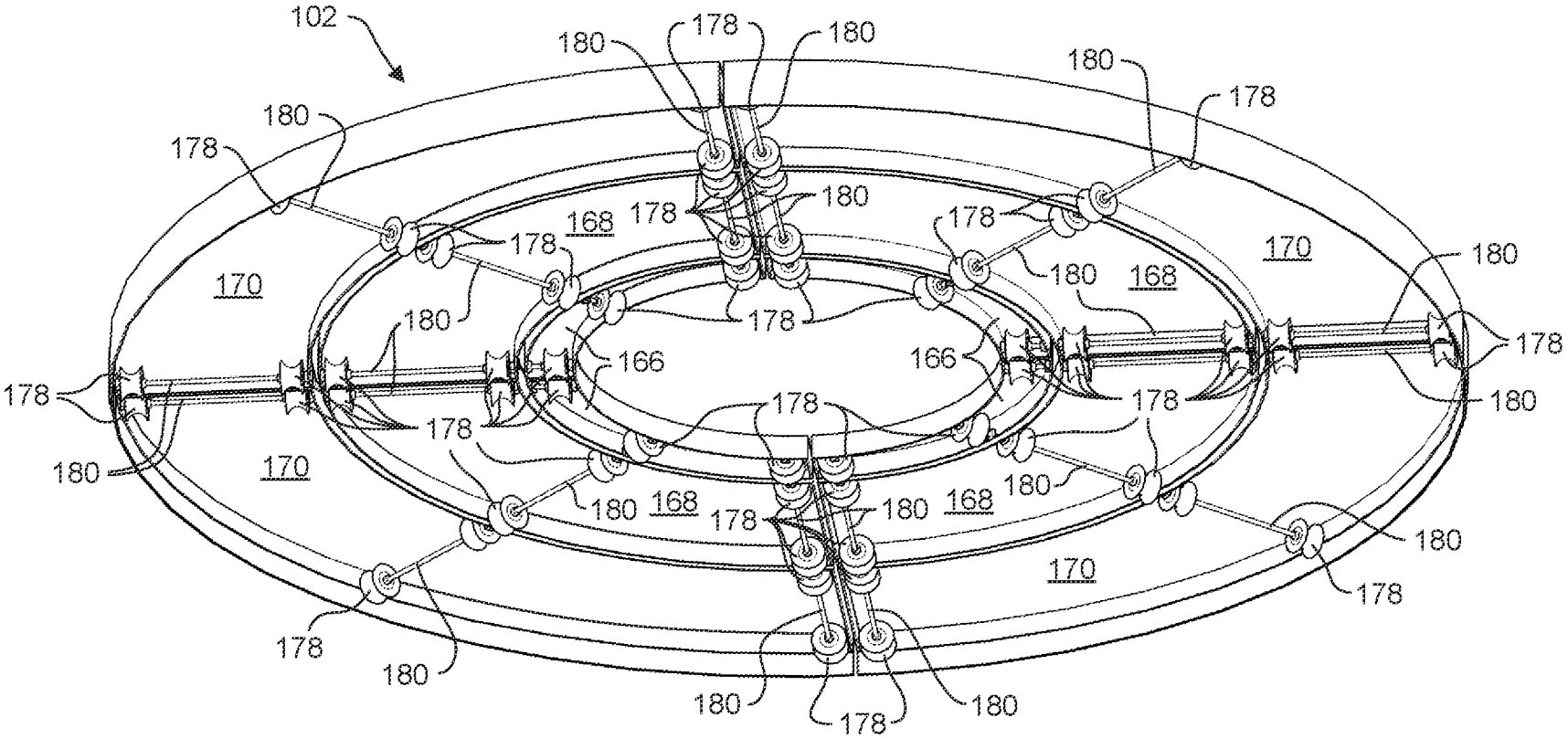
FIG. 15 is a bottom perspective view of a tabletop of the adjustable table of FIG. 1.
Figure 16:
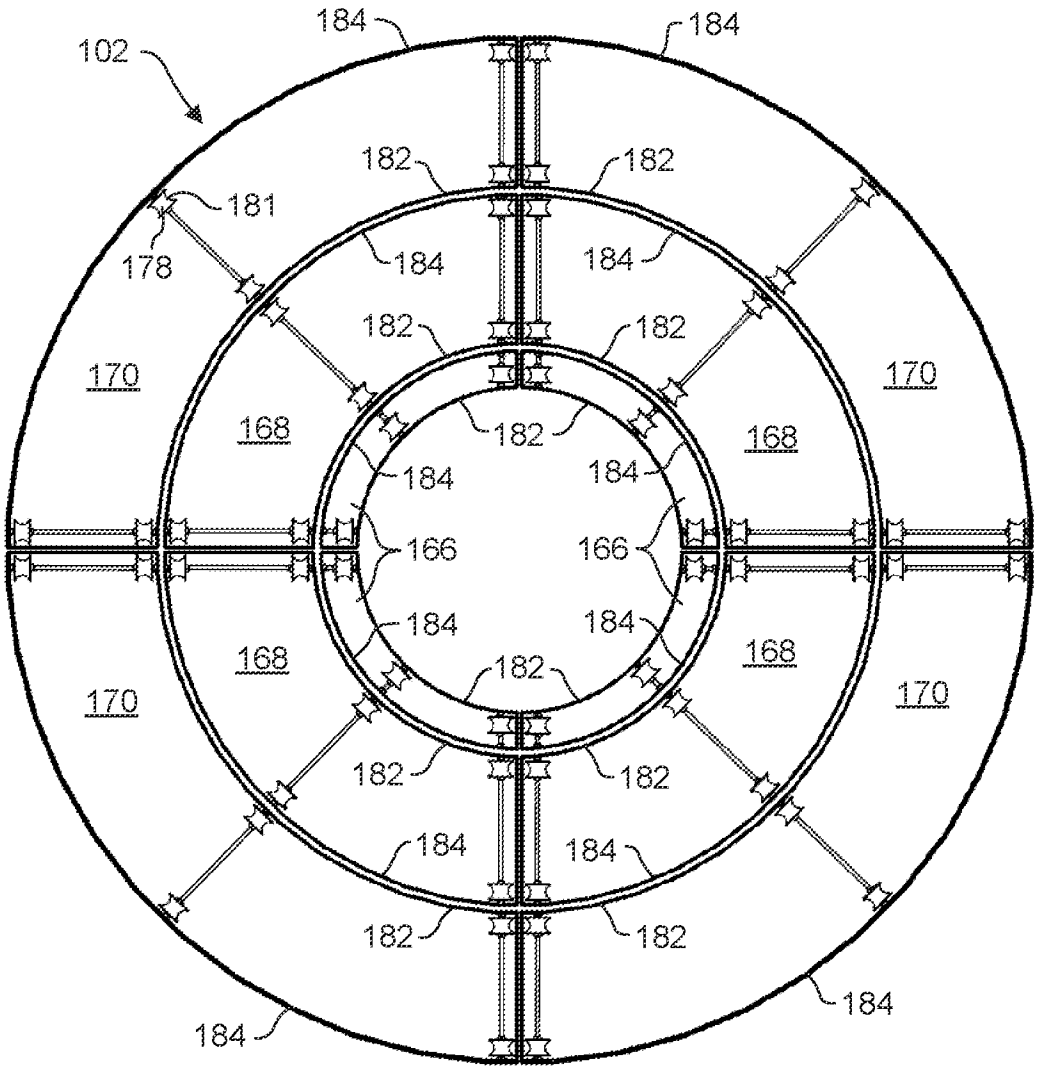
FIG. 16 is a bottom view of the tabletop of FIG. 15.

As best illustrated in FIGS. 15 and 16, each segment of the tabletop 102 is rotatable about a central vertical axis relative to the rest of the table 100. To facilitate this, each segment of the tabletop 102 includes at least one roller 178 disposed on an underside thereof. Each roller 178 is mounted on an axle 180 which extends generally from an inner wall 182 of each segment to an outer wall 184. Preferably, each axle 180 is perpendicular to the vertical axis about which the tabletop 102 is rotatable. Each roller 178 is sized to roll along a support ring 160, and in some embodiments the rollers 178 may have a groove 181 complimentary cross-section to the cross-section of the support rings 160 in order to help maintain alignment. Tabletop 102 is configured such that each tabletop ring 172, 174, and 176 is rotatable independent of the others, although in some embodiments the rings may be linked together such that they rotate in unison. In some embodiments, at least a portion of the tabletop 102 may be in the form of a lazy Susan, such as the modular central element 110. In other embodiments, the entire tabletop 102 may be formed as a single lazy Susan, wherein each of the tabletop rings 172-176 rotate together, or are formed unitary.

The tabletop 102 shown and described herein is generally annular in shape, with an open central area, which may be referred to as a modular central element 110. The modular central element 110 may be, as described above, a customizable feature of the table 100 which may include a burner or heating element. In some embodiments, the modular central element may be a grill (e.g., a gas grill or a charcoal grill) which allows a user to cook food and subsequently serve it at the same table 100. The grill may include a spherical or hemispherical grill cover 186 which may at least partially enclose the grill. Alternately, the modular central element 110 may be a fire pit supplied by a gas burner or by other means such as wood.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An adjustable table, comprising:
a tabletop;
a first helical member;
a second helical member; and
a support frame operably coupled to the tabletop and either the first helical member or the second helical member;
wherein rotation of the second helical member in one direction relative to the first helical member raises a height of the tabletop and rotation of the second helical member in an opposite direction relative to the first helical member lowers the height of the tabletop; and
wherein the first helical member is akin to the second helical member.

2. The adjustable table of claim 1, wherein each helical member comprises a plurality of helical rods having substantially similar diameters to one another.

3. The adjustable table of claim 2, wherein each helical rod extends at least approximately 450 degrees.

4. The adjustable table of claim 1, wherein the tabletop is a generally annular shape and comprises a central portion and a peripheral portion, the central portion having a diameter less than a diameter of at least one item selected from the group consisting of the first helical member and the second helical member.

5. The adjustable table of claim 4, wherein the central portion of the tabletop includes a burner.

6. The adjustable table of claim 1, wherein the tabletop is rotatable relative to the support frame about a substantially vertical axis.

7. The adjustable table of claim 1, further comprising means for temporarily locking the second helical member relative to the first helical member.

8. An adjustable table, comprising:
a tabletop;
a first helical member;
a second helical member; and
a support frame coupled to the tabletop and either the first helical member or the second helical member, the support frame comprising:
an inner support ring;
an outer support ring concentric with and connected to the inner support ring by a substantially horizontal member;
at least one vertical support member extending downwardly from the inner support ring; and
at least one angled support member connecting the outer support ring to the at least one vertical support member;
wherein rotation of the second helical member in one direction relative to the first helical member raises a height of the tabletop and rotation of the second helical member in an opposite direction relative to the first helical member lowers the height of the tabletop.

9. The adjustable table of claim 8, further comprising a plurality of additional concentric support rings, each of the additional concentric support rings having a diameter greater than a diameter of the inner support ring and less than or equal to a diameter of the outer support ring.

10. The adjustable table of claim 9, wherein the tabletop further comprises a plurality of rollers configured to roll along at least a portion of the plurality of additional concentric support rings, the tabletop being rotatable relative to the support frame.

11. The adjustable table of claim 8, wherein the at least one vertical support member is a plurality of vertical support members equally radially distributed around the inner support ring, each said vertical support member being connected to at least one said helical member.

12. An adjustable table, comprising:
a first helical rod;
a second helical rod stacked atop and being rotatable relative to the first helical rod;
a third helical rod stacked atop and being rotatable relative to the second helical rod; and
a tabletop operably coupled to the third helical rod;
wherein:
rotation of the second helical rod in a first direction relative to the first helical rod raises a height of the tabletop;
rotation of the third helical rod in the first direction raises the height of the tabletop;
rotation of the second helical rod in a second direction relative to the first helical rod lowers the height of the tabletop, the second direction being opposite the first direction; and
rotation of the third helical rod in the second direction lowers the height of the tabletop.

13. The adjustable table of claim 12, wherein the first helical rod is a plurality of helical rods.

14. The adjustable table of claim 12, wherein an upper frame is fixedly coupled to at least one helical rod helical rod and the tabletop is rotatably coupled to the upper frame.

15. The adjustable table of claim 14, wherein the upper frame comprises:
an inner support ring;
an outer support ring concentric with and connected to the inner support ring;
at least one vertical support member extending downwardly from the inner support ring and connected to at least one helical rod; and
at least one angled support member connecting the outer support ring to the at least one vertical support member.

16. The adjustable table of claim 15, wherein the tabletop is formed from a plurality of concentric arcuate segments, each said segment comprising at least one roller disposed on an underside thereof and being configured to roll along at least one said support ring.

17. The adjustable table of claim 12, further comprising means for temporarily locking the second helical rod relative to the first helical rod and means for temporarily locking the third helical rod relative to the second helical rod.

18. The adjustable table of claim 12, wherein the tabletop is generally annular in shape and is formed from a plurality of concentric arcuate segments, each segment being independently removeable from the tabletop.

19. The adjustable table of claim 12, wherein each helical rod extends at least 360 degrees and includes a substantially vertical support, the vertical support being connected to the helical rod at a first location and a second location, the first and second locations being on different horizontal planes from one another.

20. The adjustable table of claim 12, wherein the tabletop includes at least one item selected from the group consisting of a gas grill and a fire pit.

* * * * *